US006696106B1

(12) United States Patent
Schultz et al.

(10) Patent No.: US 6,696,106 B1
(45) Date of Patent: Feb. 24, 2004

(54) PRIMER FOR RADIATION CURABLE COATING COMPOSITIONS

(75) Inventors: Paul B. Schultz, Export, PA (US); Thomas L. Levendusky, Greensburg, PA (US); Ronald G. Ankney, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 43 days.

(21) Appl. No.: 10/241,632

(22) Filed: Sep. 11, 2002

(51) Int. Cl.[7] ..... B05D 1/36; B05D 1/38; B05D 3/06

(52) U.S. Cl. ..... 427/496; 427/508; 427/409; 427/410

(58) Field of Search ..... 427/496, 508, 427/409, 410

(56) References Cited

U.S. PATENT DOCUMENTS

| | | | | | |
|---|---|---|---|---|---|
| 3,759,809 | A | | 9/1973 | Carlick et al. | 204/159.23 |
| 3,783,151 | A | | 1/1974 | Carlick et al. | 260/471 |
| 3,825,479 | A | | 7/1974 | Carlick et al. | 204/159.23 |
| 3,882,187 | A | * | 5/1975 | Takiyama et al. | 525/31 |
| 5,919,517 | A | * | 7/1999 | Levendusky et al. | 427/211 |
| 6,004,629 | A | | 12/1999 | Madigan | 427/496 |
| 6,020,030 | A | | 2/2000 | Guthrie et al. | 427/345 |
| 6,030,710 | A | | 2/2000 | Nitowski et al. | 428/457 |

FOREIGN PATENT DOCUMENTS

| | | | |
|---|---|---|---|
| JP | 63-150330 | * | 6/1988 |

* cited by examiner

*Primary Examiner*—Erma Cameron
(74) *Attorney, Agent, or Firm*—Glenn E. Klepac

(57) ABSTRACT

An aluminum-polymer composite is made by coating a surface portion of an aluminum alloy body with a primer composition comprising a vinylphosphonic acid-acrylic acid copolymer to form a primer layer, coating the primer layer with a radiation curable polymer precursor, and irradiating the polymer precursor with ultraviolet or electron beam radiation. The process of the invention is particularly suitable for making polymer coated aluminum alloy sheet that is shaped into container end panels for food and beverage containers.

16 Claims, No Drawings

PRIMER FOR RADIATION CURABLE COATING COMPOSITIONS

FIELD OF THE INVENTION

The present invention relates to radiation curable coatings for aluminum alloy bodies. More specifically, the invention relates to an improved primer composition for coatings containing radiation curable polymer precursors. The product is preferably polymer coated aluminum alloy sheet suitable for shaping into end panels for food and beverage containers. Another aspect of the invention relates to polymer coated aluminum alloy extrusions for architectural uses.

BACKGROUND OF THE INVENTION

Aluminum alloy sheet coated with a polymeric composition on one or more surfaces is commonly used for shaping into end panels for food and beverage containers. The coating can be applied by processes such as reverse roll coating, gravure coating, electrocoating, spraying, powder coating, and forward roll coating. Coatings are applied to the sheet to better preserve foods and beverages stored in metal containers produced from the coated sheet, and to improve their taste characteristics. Coatings also improve the corrosion resistance, formability and appearance of the metal.

Commonly used commercial coating processes involve the use of solvent based systems that generate volatile organic compounds (VOC's) into the air. To reduce or eliminate the generation of such volatile organics during the coating process, solids coating systems have been proposed for application to the metal surface during the coating process. Examples of solids coating systems are those known as ultraviolet (UV) or electron beam (EB) curable coatings. Such coating systems generally contain monomers and oligomers so that they can be applied to substrates in a fluid state. Some coating systems may also contain small amounts of a solvent to improve fluidity during application. The monomers and oligomers react to form 100% solids coatings.

However, UV and EB curable coatings often separate from the metal substrate during end formation operations.

Accordingly, a need exists for a polymer coated metal sheet which is produced using coatings that do not generate VOC's after being cured and which has sufficient polymer adhesion to adhere to the metal during subsequent fabrication of the metal sheet into ends for beverage or food containers.

Thus, an objective of the present invention is to provide an improved primer composition for making aluminum alloy sheet using coatings that do not generate VOC's during curing and which have sufficient adhesive strength to adhere to the metal surface during subsequent fabrication of the sheet into ends for beverage or food containers.

Although aluminum and aluminum alloys protect themselves against corrosion by forming a natural oxide coating, the protection is not complete. In the presence of moisture and certain electrolytes, aluminum and its alloys may corrode very quickly. Such moisture and electrolytes may originate in acid rain water, water puddles on roadways, salted winter roads, or food materials, among others. Coatings, such as organic polymer and silicone coatings, may protect aluminum substrates to a limited extent by themselves, but are usually poorly adherent without an intermediate treatment or layer. Also, thin coatings are frequently porous, and therefore require an intermediate coating or layer to enhance corrosion resistance of the aluminum substrate.

Accordingly, there is a need to treat aluminum substrates with primers or other chemicals that provide improved corrosion resistance as well as strong bonding affinity for subsequent coatings. Suitable aluminum substrates for practice of the present invention include sheet, plate, castings, and wrought products such as forgings and stampings.

In the prior art, chemical conversion coatings have been formed on aluminum by "converting" a surface of the metal into a tightly adherent coating, part of which consists of an oxidized form of aluminum. Chemical conversion coatings provide high corrosion resistance and improved bonding affinity for polymer coatings. A chromate conversion coating is typically provided by contacting aluminum with an aqueous solution containing hexavalent or trivalent chromium ions, phosphate ions and fluoride ions. In recent years, concerns have arisen regarding the pollution effects of chromates and phosphates discharged into waterways by such processes. Because of the high solubility and strongly oxidizing character of hexavalent chromium ions, expensive waste treatment procedures must be employed to reduce the hexavalent chromium ions to trivalent chromium ions for waste disposal.

Attempts have been made in the prior art to produce acceptable chromate-free conversion coatings for aluminum. For example, some chromate-free conversion coatings contain zirconium, titanium, hafnium and/or silicon, sometimes combined with flourides, surfactants and polymers such as polyacrylic acid. In spite of the extensive efforts that have been made previously, there is still no entirely satisfactory non-chromate conversion coating or primer for improving the adhesion and corrosion resistance of coated aluminum. Two of the major problems are that the chromate free conversion coatings usually provide weaker adhesion of the subsequent coating to the substrate, or the chromate free conversion coatings usually provide less corrosion resistance in aggressive environments, or both.

A principal objective of our invention is to provide aluminum with a chromium free primer layer which provides better corrosion resistance and better adhesion of subsequent coatings than a chromate conversion coating.

A related objective of our invention is to provide coated aluminum having a primer layer comprising a reaction product of a vinylphosphonic acid-acrylic acid copolymer and an aluminum oxide or hydroxide layer on the sheet.

Additional objectives and advantages of our invention will become apparent to persons skilled in the art from the following detailed description of some particularly preferred embodiments.

SUMMARY OF THE INVENTION

In accordance with the present invention there is provided a process for making an aluminum-polymer composite. The composite comprises an aluminum alloy body coated with a radiation cured coating composition. The aluminum alloy body may be a casting, extrusion, plate, wrought product, or sheet and is preferably a sheet having a thickness of about 0.008 to 0.015 inch. Some aluminum alloys suitable for the present invention include aluminum-manganese alloys of the AA 3000 series, aluminum-magnesium alloys of the AA 5000 series, and aluminum-magnesium-silicon alloys of the AA 6000 series. For making polymer coated sheet suitable for shaping into food container bodies or food or beverage container end panels, we prefer aluminum-magnesium alloys of the AA 5000 series and particularly the AA 5042 and AA 5182 alloys. For making polymer coated sheet suitable for use on vehicle bodies we prefer aluminum-magnesium-silicon alloys of the AA 6000 series.

Aluminum alloys suitable for container end panels such as AA5182 are provided as an ingot or billet or slab by casting. Before working, the ingot or billet is subjected to elevated temperature homogenization. The alloy stock is then hot rolled to provide an intermediate gauge sheet. For example, the material may be hot rolled at a metal entry temperature of about 700–950° F. to provide an intermediate product having a thickness of about 0.130 inch to about 0.190 inch. This material is cold rolled to provide a sheet ranging in thickness from about 0.007 to 0.014 inch. A preferred metal sheet is AA5182 aluminum alloy sheet in either the H19 or H39 temper.

Aluminum alloys such as AA5042 are provided as an ingot that is homogenized. This procedure is followed by hot rolling to an intermediate gauge of about 0.125 inch. Typically, the intermediate gauge product is annealed, followed by cold rolling to a final gauge of about 0.007 to 0.014 inch. A preferred metal sheet is AA5042 aluminum alloy sheet in the H2E72 temper.

The aluminum alloy sheet is generally cleaned with an alkaline surface cleaner to move any residual lubricant adhering to the surface, and then rinsed with water. Cleaning may be avoided if the residual lubricant content is negligible.

The cleaned sheet surface is then primed with a primer composition comprising an aqueous solution of about 1–20 g/L of a vinyl phosphonic acid-acrylic acid copolymer VPA-AA copolymer). Solutions containing about 4–10 g/L of the copolymer are preferred. The copolymer usually comprises about 5–50 mole % vinylphosphonic acid, preferably about 20–40 mole %. A particularly preferred VPA-AA copolymer contains about 30 mole % VPA and about 70 mole % AA. The solution has a temperature of about 100–200° F., more preferably about 120–180° F. A particularly preferred solution has a temperature of about 170° F.

The sheet surface may be dipped into the primer composition or the composition may be roll coated or sprayed onto the sheet surface. A preferred continuous cleaning and pretreating line is operated at about 1000–1500 feet per minute. A contact time of about 6 seconds between the sheet surface and the primer composition is sufficient when the line is operated at 1000 feet per minute. The VPA-AA copolymer reacts with the oxide or hydroxide coating to form a primer layer on the sheet surface.

Optionally, the primed sheet may be rinsed with water to remove a portion of the VPA-AA copolymer unreacted with the oxide or hydroxide coating. The rinse water preferably has a temperature of about 170–180° C. The rinse water is concentrated by removing excess water so that the VPA-AA copolymer can be recycled. Some preferred concentrating techniques include reverse osmosis and membrane filtration.

The polymer is applied to the primer layer on the aluminum alloy sheet as a radiation curable polymer precursor. Radiation curable polymer precursors are monomeric and/or oligimeric materials such as acrylics, methacrylates, epoxies, polyesters, polyols, glycols, silicones, urethanes, vinyl ethers and combinations thereof which have been modified to include functional groups and optionally photoinitiators that trigger polymerization upon the application of ultraviolet (UV) or electron beam (EB) radiant energy. Such polymer precursors include acrylated aliphatic oligomers, acrylated aromatic oligomers, acrylated epoxy monomers, acrylated epoxy oligomers, aliphatic epoxy acrylates, aliphatic urethane acrylates, aliphatic urethane methacrylates, allyl methacrylate, amine-modified oligoether acrylates, amine-modified polyether acrylates, aromatic acid acrylate, aromatic epoxy acrylates, aromatic urethane methacrylates, butylene glycol acrylate, silanes, silicones, stearyl acrylate, cycloaliphatic epoxides, cyclohexyl methacrylate, ethylene glycol dimethacrylate, epoxy methacrylates, epoxy soy bean acrylates, glycidyl methacrylate, hexanediol dimethacrylate, isodecyl acrylate, isoctyl acrylate, oligoether acrylates, polybutadiene diacrylate, polyester acrylate monomers, polyester acrylate oligomers, polyethylene glycol dimethacrylate, stearyl methacylate, triethylene glycol diacetate, and vinyl ethers.

The polymer coatings for use in this invention are thermosetting polymers that cross link and cure when exposed to suitable radiation sources.

The preferred polymer precursors are acrylated epoxy monomers and oligomers polyester acrylates, and silicone monomers.

Photoinitiators suitable for use in this invention are materials which absorb UV and EB radiant energy and form reactive free radicals, cations, or anions which initiate polymerization of monomeric and oligomeric materials. Such materials include acryloins, ketones, substituted benzoquinones, substituted polynuclear quinones, halogenated aliphatic, alicyclic and aromatic hydrocarbons, and mixtures thereof. In an embodiment of our invention illustrated in the Examples, UV radiation interacts with a cationic photoinitiator to addition polymerize an epoxy precursor.

Photoinitiators may not be necessary for use with polymeric precursors that contain function groups that are sufficiently reactive to polymerize upon irradiation particularly with EB radiation.

Preferred polymer resins precursor systems are sold commercially by Sun Chemical Company under the registered trademarks Sunbeam and Suncure.

The polymer coating composition may also optionally contain additives such as dyes, pigment particles, anticorrosion agents, antioxidants, adhesion promoters, light stabilizers, lubricants, and mixtures thereof.

The polymer precursor coating composition may be applied to the sheet by any of several techniques, including gravure coating, slot coating, forward roll coating, reverse roll coating, spraying, powder coating, and electrostatic coating. Reverse roll coating is particularly preferred. The polymer precursor coating is preferably applied onto the metal sheet as a single layer. Preferably, both sides of an aluminum alloy sheet are coated with a polymer precursor coating leaving a thickness of about 0.01–0.5 mils (1–13 microns).

To cure the polymer precursor coating composition, the aluminum-polymer composite sheet is irradiated with an electron beam. The electron beam polymerizes and cross links the coating. The radiation dose is about 2–20 megarads, preferably about 5–15 megarads. Electron beam radiation is the preferred energy for curing the polymer precursor coatings used for this invention, however, alternatively, UV radiation may also be used. The radiation curing step does not result in any substantial temperature increase in the coating. The coating temperature is less than about 250° F. (121° C.) after curing.

Optionally the composite sheet may then be heated by convection or induction heating to temperatures between 350–450° F. The exposure time needed for this heating step will depend upon the thickness of the substrate being coated, and the speed at which the substrate (e.g., coil stock) traverses through the convection or induction heating units. A typical exposure time may range from 10–15 seconds.

The inventors believe the polymer precursor coating applied to the metal sheet is sufficiently viscous to bridge peaks in the irregular microsurface of the metal sheet. When the precursor coating is polymerized by radiant energy, the polymer networks across the metal surface peaks. By networking across the peaks, the polymer does not adhere as strongly to the metal as if the polymer inhabited the pockets, grooves, and other features of the metal microsurface. Heating of the metal-polymer composite sheet causes the polymer to flow into the metal surface irregularities. Upon cooling of the sheet, the polymer hardens within the irregularities in the metal surface thereby increasing the strength of the polymer adherence to the metal sheet.

The irradiated and heat treated composites sheets are shaped into container end panels for food and beverage containers. Easy open end panels for carbonated beverages are generally shaped by stamping metal blanks between shaping dies.

In a preferred embodiment of the invention, sheets of metal coated with a polymer precursor are exposed to EB radiation and heated before the sheets are formed into container ends. However, heating of a metal sheet coated with a polymer precursor prior to irradiation with EB energy is also within the scope of this invention. Also, sheets of metal coated with a polymer precursor can be exposed to EB radiation, formed into container ends and heated within the scope of this invention.

The invention will now be further described with reference to a number of specific examples which are to be regarded solely as illustrative and not as restricting the scope of the present invention.

DETAILED DESCRIPTION OF PREFERRED EMBODIMENTS

In accordance with the present invention there is provided an AA5182 aluminum alloy sheet in the H19 temper having a sheet thickness of about 0.0080–0.0090 in (0.20–0.23 mm) and preferably about 0.0084 in (0.21 mm).

The natural oxide coating on aluminum surfaces is generally sufficient for practice of the invention. The natural oxide coating ordinarily has a thickness of approximately 30–50 angstroms. Also, the oxide coating resulting after cleaning, cleaning and etching, or cleaning, etching, and desmutting the aluminum is sufficient for practice of our invention. It is not necessary to grow the oxide coating by treatments such as anodic oxidation or hydrothermal treatment in water, water vapor or aqueous solutions, although this is possible.

The aluminum to be coated is cleaned with alkaline or acid surface cleaner to remove any residual organic contaminants adhering to the surface, and then rinsed with water. Cleaning might be avoided if the organic contamination is negligible.

The cleaned aluminum is then primed with a primer composition comprising an aqueous solution of about 0.1–200 g/L of a vinyl phosohonic acid-acrylic acid copolymer (VPA-AA copolymer). Solutions containing about 1–20 g/L of the copolymer are preferred. The copolymer usually comprises about 5–50 mole % vinylphosphonic acid, preferably about 20–40 mole %. A particularly preferred VPA-AA copolymer contains about 30 mole % VPA and about 70 mole % AA. The solution has a temperature of between 50° F. and 200° F. There is an inverse relationship between time and temperature required: the lower the temperature, the longer the time required, or the shorter the time available, the higher the temperature required. A "Room Temperature" of 65° F. to 85° F. is preferred with an immersion time of 15 seconds to 2 minutes, which minimizes equipment and heating requirements. Where speed is critical, a temperature of 170° F. and a time of 15 seconds is preferred. Many different combinations of time and temperature are possible.

The aluminum surface may be dipped into the primer composition or the composition may be roll coated or sprayed onto the sheet surface. The VPA-AA copolymers reacts with the oxide or hydroxide coating to form a primer layer on the sheet surface.

Optionally, the aluminum may be rinsed with water to remove a portion of the VPA-AA copolymer unreacted with the oxide or hydroxide coating. The rinse water may have temperature of 35° F. to 200° F. Room temperature water is preferred, unless quick drying is required, in which case heated water speeds the water drying process. The rinse water may be concentrated by removing excess water so that the VPA-AA copolymer can be recycled. This improves the economics of the process, but does not affect the invention. Some preferred concentrating techniques include reverse osmosis and membrane filtration.

The roll coating apparatus applies to the aluminum sheet a coating of a polymer precursor having a thickness of approximately 0.0001–0.0005 in (2.5–13 microns), thereby to form an aluminum-polymer composite.

The polymer coating in the composite is irradiated by an electron beam. A suitable electron beam generator is commercially available from Energy Sciences, Inc. of Wilmington Mass. under the trade designation ESI "ELECTROCURE" EB SYSTEM.

Optionally, the surface coated with the UV or EB coatings may then be subjected to thermal or induction heating by raising the metal temperature to a range of 350–450° F.

Finally, the aluminum-polymer composite is cooled (preferably with water) and dried.

EXAMPLES

1. Samples of AA 5182 sheet were either cleaned only, cleaned and chrome conversion coated, or cleaned and primed with a VPA-AA copolymer solution. The samples were then coated with either 5 msi (0.25 mil) of a 95% by weight solids cationic epoxy coating, or 2 msi (0.1 mil) of a 60% by weight solids cationic epoxy coating, and cured by UV light.

a. The coated samples were tested for dry feathering and angel hair formation. Dry feathering refers to a membrane remaining in a spout opening when a dry can tab is pulled and removed. Maximum acceptable is 0.030 inch. Average dry feathering on 5 tabs tested was as follows:

| | 2 msi | 5 msi |
|---|---|---|
| Clean Only | 10 | 179 |
| Chrome Conversion | 92 | 181 |
| VPA-AA Copolymer | 4 | 159 |

Dry feathering resistance was excellent for the 2 msi coated samples primed with VPA-AA and for the cleaned only samples, but unacceptable for chrome. The 5 msi coated samples all performed badly.

b. Another set of coated samples was tested for angel hair filaments generated at the score line of a can tab when the tab is pulled. Five tabs were pulled and angel hair formation was observed. The following table shows total number of angel hairs observed for all 5 tabs, and total length (in thousandths of an inch) of those hairs.

| | 2 msi | | 5 msi | |
|---|---|---|---|---|
| | Number | Length | Number | Length |
| Clean Only | 10 | 710 | 13 | 6000 |
| Chrome | 12 | 4400 | 16 | 6625 |
| VPA-AA Copolymer | 4 | 65 | 9 | 7600 |

The VPA-AA primed substrate with a 2 msi coating had 3 tabs with no angel hair, 1 tab with 0.020 and 0.010 inch angel hairs and 1 tab with 0.025 and 0.010 inch angel hairs. All other samples had at least 4 angel hairs that were each at least 0.100 inch long, and were definitely unacceptable.

c. Additional test were run on specimens of AA 5182 alloy sheet, conversion coated with a chrome-phosphate solution or primed with a VPA-AA copolymer, as follows;

FLAT SHEET ADHESION (#610 TAPE)
Chrome treatment: trace to pickoff
VPA-AA treatment: no pickoff
FLAT SHEET ADHESION AFTER WATER PASTEURIZATION (180° F., 30 MIN)
Chrome treatment: slight to heavy pickoff
VPA-AA treatment: none to slight pickoff
206 DIAMETER SHELL ADHESION
Chrome treatment: coating flaked off the curl
VPA-AA treatment: 100% adhesion on the curl
202 DIAMETER SHELL ADHESION AFTER POST HEATING THE FLAT SHEET @ 430° F. PMT
Chrome treatment: 100% adhesion on the curl
VPA-AA treatment: 100% adhesion on the curl
202 DIAMETER SHELL ADHESION AFTER POST HEATING @ 430° F. PMT PASTEURIZATION
Chrome treatment: coating flaked off curl
VPA-AA treatment: no coating flake off on curl, some scuffing from Formatec rotary curler
202 DOUBLESEAM ADHESION AFTER POST HEATING THE FLAT SHEET @ 430° F. PMT
Chrome treatment: coating flaked off the top of the double seam
VPA-AA treatment: 100% adhesion
202 DOUBLESEAM ADHESION (POST HEATED SHEET & WATER PASTEURIZATION)
Chrome treatment: more coating flaked off the top of the double seam; coating flaked off the bottom of the double seam
VAP-AA treatment: coating flaked off the top and bottom of the double seam (less than the chrome treatment)

The foregoing disclosure of our invention has been made with reference to some particularly preferred embodiments. Persons skilled in the art will understand that numerous changes and modifications can be made without departing from the spirit and scope of the following claims.

What is claimed is:

1. A process for making an aluminum-polymer composite, comprising steps of:

a) providing an aluminum alloy body having a surface portion, b) coating said surface portion with a primer composition comprising a vinyl phosphonic acid-acrylic acid copolymer, thereby to form a primer layer, c) coating said primer layer with a coating composition comprising a radiation curable polymer precursor, and d) irradiating said polymer precursor with ultraviolet or electron beam radiation in an amount sufficient to polymerize said polymer precursor, thereby to form an aluminum-polymer composite.

2. The process of claim 1 further comprising e) heating said aluminum-polymer composite to an elevated temperature, thereby to adhere said polymer better to said aluminum alloy body.

3. The process of claim 1 wherein said body is a sheet comprising an aluminum-maganese alloy of the AA 3000 series, an aluminum-magnesium alloy of the AA 5000 series, or an aluminum-magnesium-silicon alloy of the AA 6000 series.

4. The process of claim 1 wherein said copolymer comprises about 5–50 mole % vinylphosphonic acid.

5. The process of claim 1 wherein said copolymer comprises about 20–40 mole % vinylphosphonic acid.

6. The process of claim 1 wherein said primer composition comprises about 1–20 g/L of said copolymer dissolved in water.

7. The process of claim 1 wherein said polymer precursor is selected from the group consisting of epoxy acrylates, polyester acrylates, and silicones and step (d) comprises irradiating with electron beam radiation.

8. The process of claim 1 wherein said polymer precursor is selected from epoxy acrylates, polyester acrylates, and silicones, and step (d) comprises irradiating with ultraviolet radiation.

9. The process of claim 1 wherein step (d) comprises irradiating at a dosage of about 2–20 megarads.

10. The process of claim 1 wherein said surface portion comprises aluminum oxide or aluminum hydroxide.

11. The process of claim 1 wherein said body is a sheet comprising an aluminum alloy of the AA 3000 or AA 5000 series and said process further comprises shaping said sheet into a container body or container end panel.

12. A process for making polymer coated aluminum alloy sheet suitable for shaping into container bodies and container end panels, comprising a) pretreating a surface portion of an aluminum aloy sheet with a primer composition comprising a vinylphosphonic acid-acrylic acid copolymer comprising about 5–50 mole % vinylphosphonic acid groups, thereby to form a primer layer on said sheet, b) coating said sheet primer layer with a coating composition comprising a radiation curable polymer precursor selected from epoxy acrylates, polyester acrylates, and silicones, and c) irradiating said polymer precursor with ultraviolet or electron beam radiation at a dosage level of about 2–20 megarads, thereby to polymerize said polymer precursor and to form an aluminum alloy sheet having a polymer coating.

13. A process of claim 12 wherein said polymer coating has a temperature of less than about 121° C. (250° F.) after step (c), and further comprising d) heating said polymer coating to an elevated temperature of about 149–200° C. after step (c), thereby to adhere said coating better to said sheet.

14. A process of claim 12, further comprising e) shaping the polymer coated sheet into a container end panel for food and beverage containers.

15. Polymer coated aluminum alloy sheet made by the process of claim 12.

16. A polymer coated aluminum alloy container end panel made by the process of claim 14.

* * * * *